United States Patent [19]

Flynn

[11] Patent Number: 4,945,599

[45] Date of Patent: Aug. 7, 1990

[54] CAP SYSTEM FOR SPONGE MOPS

[76] Inventor: Angela Flynn, c/o FLower Fresh, Inc., P.O. Box 191, Allendale, N.J. 07401

[21] Appl. No.: 359,976

[22] Filed: Jun. 1, 1989

[51] Int. Cl.[5] ..... A47L 13/16

[52] U.S. Cl. ..... 15/244.3; 15/105; 15/118; 15/227; 15/247

[58] Field of Search ..... 15/105, 118, 228, 231, 15/244.1, 244.3, 246, 247

[56] References Cited

U.S. PATENT DOCUMENTS

| | | | |
|---|---|---|---|
| 2,301,586 | 11/1942 | Rubin | 15/247 X |
| 2,526,119 | 10/1950 | Cravis | 15/247 X |
| 3,012,264 | 12/1961 | Nash | 15/247 X |
| 4,670,962 | 6/1987 | Giallourakis | 15/244.3 X |
| 4,793,019 | 12/1988 | Stima et al. | 15/244.1 X |

FOREIGN PATENT DOCUMENTS

| | | | |
|---|---|---|---|
| 678657 | 7/1939 | Fed. Rep. of Germany | 15/247 |
| 1252344 | 12/1960 | France | 15/247 |
| 481824 | 3/1988 | United Kingdom | 15/247 |

*Primary Examiner*—Chris K. Moore
*Attorney, Agent, or Firm*—Natter & Natter

[57] ABSTRACT

A cap formed of terry cloth fabric is dimensioned to fit over the head of a sponge mop and cover its sponge element as well as the peripheral edges of a sponge element attachment plate. The terry cloth fabric includes loose cotton loops projecting from both sides of a ground farbic. An elastic band is carried in a peripheral hem to gather the edges of the cap over the top of the attachment plate and assure a snug fit.

7 Claims, 2 Drawing Sheets

FIG. 1
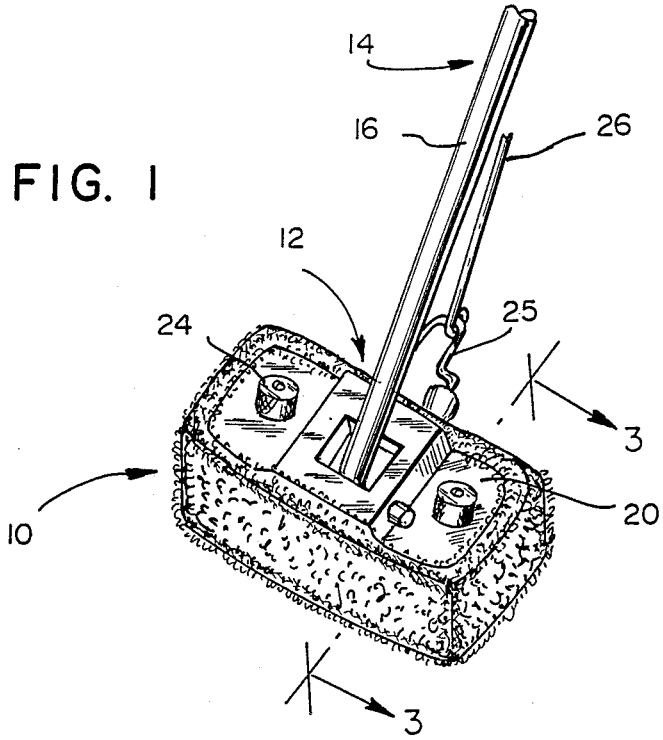
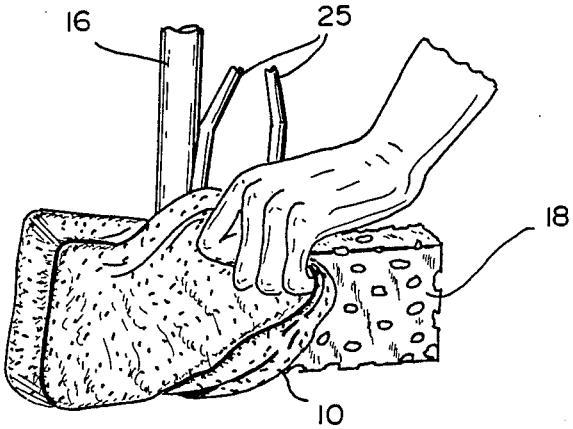
FIG. 2
FIG. 3
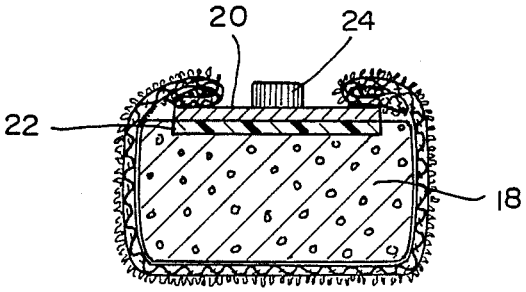

FIG. 4
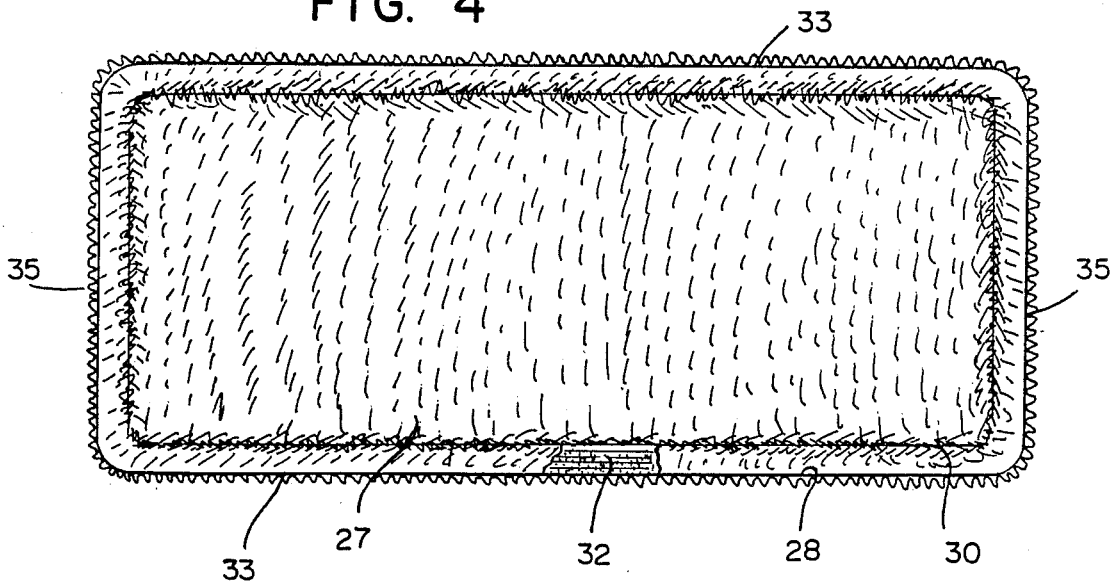
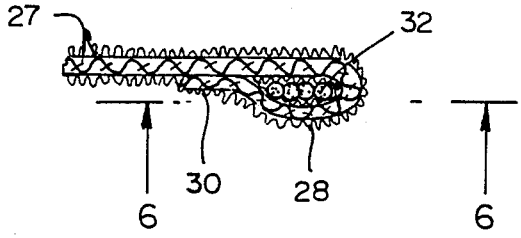
FIG. 5
FIG. 6
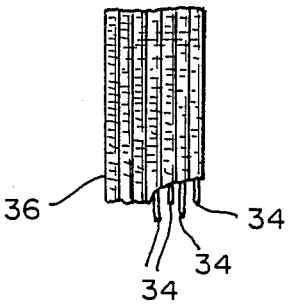
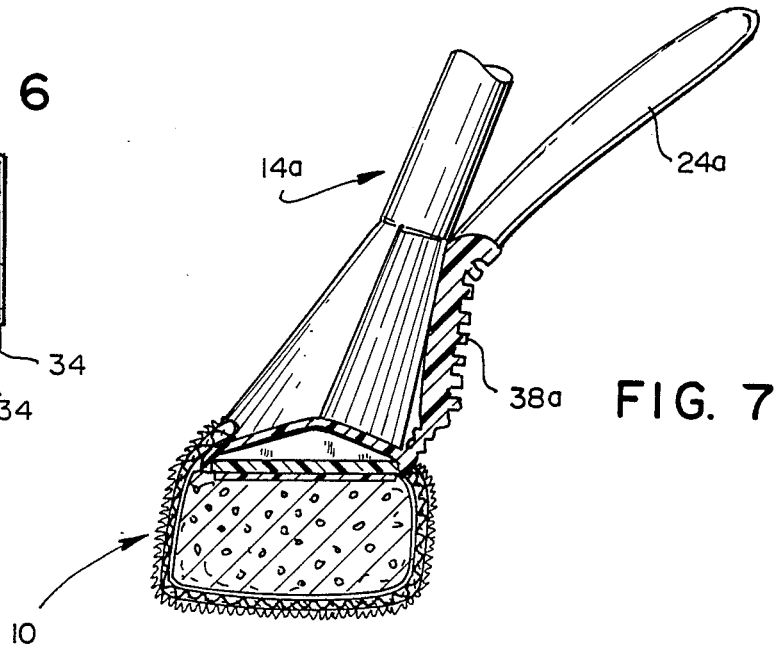
FIG. 7

CAP SYSTEM FOR SPONGE MOPS

BACKGROUND OF THE INVENTION

1. Field of the Invention

The invention relates generally to mops and deals more specifically with improvements in sponge mops.

2. Prior Developments

Floor cleansing and polishing has constituted a dreaded chore. Some continued to resort to the time honored methods of the past which included assiduous scrubbing with a brush and bucket on one's hands and knees. In the more recent past, such method has been considered a practice which has virtually outlived its days.

By far, the majority of workers whose tasks in either a commercial or residential housekeeping setting involved floor cleaning have utilized, at the least, an ansate adaptation of hand grasped brushes and, more prevalently, have utilized mops.

Traditionally, mops constituted a bundle of loose rags or yarn bound together to the end of an elongate shaft or stick. Floor cleaning procedures with mops entailed the arduous application of a wet, preferably soap, detergent and/or disenfectant laden rag or yarn mop head to the floor surface accompanied by frequent rinsing and ringing of the rag or yarn mop head.

Development of mops having heads with cellulose sponge elements reduced efforts involved in floor cleaning by, among other things, providing a light weight and easy to rinse mop. Sponge mops have become the most popular floor cleansing apparatus used in household applications. Sponge mops included a mop head having an attachment plate for mounting and supporting a replaceable sponge element. In addition, a pivoted clamp plate was frequently employed to squeeze the sponge for rinsing. Other devices which have been utilized for compressing a sponge element on a mop head included various roller mechanisms, for example that illustrated in U.S. Pat. No. 4,196,488 as well as lever actuated folding attachment plates.

Although the introduction of sponge mops proved to be readily accepted, there were problems encountered in conjunction with the use of such devices. Unfortunately, the sponge elements were susceptible to wear due to contact with floor surfaces as well as repeated compression during rinsing. In addition, the remaining portion of the mop head, e.g. the attachment plate, was often formed of metal and contained hard, sharp edges which were prone to cause scratches, nicks, mars or other injury to furniture, cabinets and the like.

A notable further disadvantage of sponge mops was the fact that they invariably left streaks upon the floor surface. This factor also rendered them unsuitable for applying wax or polish.

Due to the relatively high coefficient of friction between the sponge element and the floor, especially when in contact with dry floors, excessive sponge wear resulted upon contact with a dry floor. When attempting to mop a spill, for example, one was required to start movement of the mop on the spill itself, rather than on a dry portion of the floor.

Due to these and other disadvantages, commercial and industrial mopping applications continued to rely upon yarn mops. Their use was preferred because such mops had a longer useful life, were not prone to injure fixtures or furniture, and did not result in the excessive streaking which accompanied the use of sponge mops.

Among the disadvantages of the cotton yarn mops which rendered them impractical for residential household use was their excessive weight as compared to that of sponge mops and the difficulty in rinsing the mop heads. Since it was almost impossible to wring a yarn mop by hand, a lever compressing apparatus was almost mandatory. Various lever actuated compression mechanisms were divised for attachment to a bucket for the purpose of squeezing the dirt laden liquid from yarn or rag mop heads in most industrial applications.

The need was present, therefore, to provide an improvement in sponge mops which would increase the life of the sponge element, alleviate the streaking which accompanied sponge mop usage, prevent injury to fixtures and furniture and facilitate usage in polishing applications.

SUMMARY OF THE INVENTION

In compendium, the present invention comprises a cotton terry cloth cap which fits over a sponge element mop head including the entire sponge element and edges of a sponge element attachment plate. An endless elastic band is carried within a peripheral hem to assure a snug fit and secure the cap in place. The cap provides a soft, resilient, liquid absorbent interface layer between the sponge element and the floor surface.

From the foregoing summary it will be appreciated that it is a consideration of the present invention to provide a cap system of the general character described for sponge mops which is not subject to the disadvantages of the prior developments aforementioned.

As aspect of the present invention is to provide a cap system of the general character described for sponge mops which is low in cost.

It is a feature of the present invention to provide a cap system of the general character described for sponge mops which is simple in construction and easy to use.

To provide a cap system of the general character described for sponge mops which reduces streaking is a further aspect of the present invention.

Another feature of the present invention is to provide a cap system of the general character described for sponge mops which prolongs sponge element life and increases the interval between sponge element replacement.

A further feature of the present invention is to provide a cap system of the general character described for a sponge mop which provides a simple to attach soft, resilient, liquid absorbent interface between the sponge element and a floor surface.

To provide a cap system of the general character described for a sponge mop which permits use of a sponge mop for applying a liquid to a floor surface without streaking is a further feature of the present invention.

Another consideration of the present invention is to provide a cap system of the general character described for sponge mops which increases the absorbency of a sponge element mop head.

Yet another aspect of the present invention is to provide a cap system of the general character described for a sponge mop which protects fixtures and furniture from injury.

To provide a cap system of the general character described for sponge mops which maintains a sponge element in a relatively clean condition is yet another consideration of the present invention.

The provision of a cap system of the general character described for sponge mops which permits usage of sponge mops for floor polishing is a further consideration of the invention.

Other aspects, features and considerations in part will be obvious and in part will be pointed out hereinafter.

With these ends in view, the invention finds embodiment in certain combinations of elements, arrangements and parts and series of steps by which the said aspects, features and considerations and certain other aspects, features and considerations are attained all as fully described with reference to the accompanying drawings and the scope of which will be more particularly pointed out and indicated in the appended claims.

BRIEF DESCRIPTION OF THE DRAWINGS

In the following drawings in which are shown one of the various possible exemplary embodiments of the invention, FIG. 1 is a perspective illustration of a sponge mop of conventional design which includes a mop head having a sponge element and a cap system in accordance with and embodying the present invention;

FIG. 2 is a perspective illustration of a typical procedure for securing a cap in accordance with the invention over the head of the mop illustrated in FIG. 1;

FIG. 3 is a cross-sectional view through the mop head, the same being taken substantially along the plane 3—3 of FIG. 1 and showing the cap which includes an elastic band carried within a hem;

FIG. 4 is a plan view of a flatened cap with a portion of the hem broken away to illustrate the elastic band;

FIG. 5 is an enlarged scale fragmentary sectional view through the hem and an adjacent area of the cap;

FIG. 6 is an auxiliary fragmentary view of the elastic band, taken substantially along the plane 6—6 of FIG. 5; and FIG. 7 is a sectional view through a mop head of alternate construction showing the cap system of the present invention secured over a sponge element.

DESCRIPTION OF THE PREFERRED EMBODIMENT

Referring now in detail to the drawings, the reference numeral 10 denotes generally a cap system constructed in accordance with and embodying the invention. Shown in FIG. 1 is the cap system securely attached to a mop head 12 of a floor mop 14 of conventional construction.

The mop 14 includes a handle or stick 16 to the lower end of which is secured to the mop head 12. The head 12 includes a polyhedron shaped cellulose sponge element 18 having substantially rectangular faces lying in substantially parallel planes with adjacent faces being substantially perpendicular to one another. The sponge element 18 is mounted to an attachment plate 20 through an integral upper panel 22 of the sponge element 18 which includes a pair of threaded posts. The posts project through apertures in the attachment plate 20 and are engaged by thumb nuts 24.

Rinsing of the sponge element 18 is achieved through a mechanical linkage which includes a lever arm 25 engaged by an actuating rod 26. Movement of the rod 26 causes the arm 24 to fold the attachment plate 20 and the sponge element 18 about its transverse axis to expel soil carrying liquids from both the sponge and the cap system 10.

The cap system comprises a generally rectangular panel 27 of woven cotton terry cloth. The cloth is fabricated by weaving a ground fabric with an extra set of loops projecting from both sides. Known weaving processes for fabrication include raising one set of ground warp, passing a weft across, raising a set of pile warp and passing a rod through the web, again raising the ground warp, passing the weft across and removing the rods after several repetitions. A loose pile of loops results from the removal of the rods. By providing tension in the ground warp and slack to the pile warp, slack yarns are pushed into loops on both faces of the cloth when the weft is beaten.

Referring now to FIG. 4, the cap system 10 shown therein is in distorted flattened plan format; it will be seen that the panel 27 is generally rectangular and includes a peripheral hem 28 of folded over material which is stitched back to the panel 27 along a stitch line 30. The hem includes a pair of parallel longitudinal edges 33 and a pair of parallel ends 35.

Carried within the hem 28 is an elastic band 32 which may be formed of any resilient stretchable material. The band may comprise a plurality of synthetic or natural rubber core elements 34 with a yarn or other fiber wrapping 36. The wrapping 36 provides a smooth surface which permits relative movement between the interior of the hem and the core elements 34 and also provides a lattice for positioning the core elements. Alternately, in lieu of synthetic or natural rubber core elements, a synthetic expandable fiber such as spandex may be utilized with or without a wrapping.

It should be appreciated that the flattened plan view of FIG. 4 is not a natural representation since the elastic band 32 gathers the peripheral edges and provides a three dimensional configuration.

In accordance with the invention, the cap system 10 is placed over the sponge element 18 as well as bordering areas of the attachment plate 20 by grasping the hem at an end 35 as illustrated in FIG. 2. The opposite end 35 is slipped over an end of the mop head and the hem is pulled toward and is slipped over the other end of the mop head. The elastic band 32 stretches to accommodate the sponge element 18 and the peripheral areas of the attachment plate 20 such that the soft, highly absorbent terry cloth panel 27 snuggly covers the entire sponge element 18 and all sharp or hard edges of the attachment plate 20 as shown in FIGS. 1 and 3.

Normal mopping procedures are then employed, including dipping the mop head in soap, detergent and/or disenfectant carrying liquid, wringing liquid from the sponge element by folding the attachment plate 20 and cleansing the floor by reciprocal movement of the head with the fabric panel 27 of the cap system 10 contacting the floor surface. Rinsing the soil or dirt carrying liquid from the sponge and cap is achieved in the normal fashion. In addition, a dry or damp mop may be used for polishing applications.

As previously discussed, use of the soft cotton terry cloth panel 27 in contact with the floor surface greatly alleviates the streaking problems previously encountered with sponge elements and also reduces wear of the sponge element. Further, a major portion of soil which is not rinsed out of the mop head is absorbed by the cap rather than the sponge itself. The cap thus acts as a filter to reduce soiling of the sponge element 18.

When the cap system 10 becomes soiled it may be easily laundered in a conventional manner and/or turned inside out for reuse since the fiberous loops project from both faces of the panel 27.

Shown in FIG. 7 is the cap system 10 secured over the head of a mop 14*a* of alternate construction. The mop 14*a* includes a compression jaw 38*a* which is unitarily joined to a molded plastic attachment plate 20*a* by a living hinge. The compression jaw 38*a* is actuated by a hand lever 24*a*. Since a longitudinal edge of the attachment plate 20*a* is joined to the jaw 38*a*, the hem 28 of the cap system 10 may only be brought up to the level of the hinge along the rear edge of the attachment plate. The cap system 10 does not, however, interfere with normal mopping and rinsing operations and does cover all exposed edges of the attachment plate.

Thus it will be seen that there is provided a cap system for a sponge mop which achieves the various aspects, features and considerations of the present invention and which is well adapted to meet the conditions of practical usage and is universally adaptable to be employed with virtually all current sponge mop structures.

As various changes might be made in the cap system for a sponge mop herein described without departing from the spirit of the invention, it is to be understood that all matter herein described or shown in the accompanying drawings is to be interpreted as illustrative and not in a limiting sense.

Having thus described the invention, there is claimed as new and desired to be secured by Letters Patent:

1. A cap system for sponge mop, the sponge mop including a mop head, the mop head having a sponge element, and attachment plate, the cap system including a cap comprising a liquid permeable terry cloth fabric panel permitting flow of liquid to and from the sponge element, an outer surface of the panel including a mopping surface, the fabric panel being dimensioned for the cap to snugly cover the sponge element and peripheral edges of the attachment plate when secured to the mop head, means for releasably securing the fabric panel to the mop head in a position covering the sponge element and peripheral edges of the attachment plate, the securing means comprising an elastic band and means for permanently securing the elastic band to the fabric panel adjacent the periphery of the fabric panel, the elastic band being stretched when the fabric panel is secured to the mop head, the sponge element and the cap forming an integrated unit.

2. A cap system for sponge mops as constructed in accordance with claim 1 wherein the fabric panel includes cotton loops projecting from each side of the panel.

3. A cap system for sponge mops as constructed in accordance with claim 1 wherein the means securing the elastic band to the fabric panel comprises a peripheral hem, the elastic band being positioned within the hem.

4. A cap system for sponge mops as constructed in accordance with claim 1 wherein the elastic band is configured in an endless loop.

5. A cap system for sponge mops as constructed in accordance with claim 1 wherein the elastic band is formed of a plurality of rubber core elements and means positioning the core elements parallel to one another, the positioning means including a yarn wrapped about each of the elements.

6. A method of assembling an integrated mop unit and cleaning floors with a sponge mop having a mop head which includes a sponge, an attachment plate for releasably mounting the sponge and a cap system as constructed in accordance with claim 1, the method comprising the steps of:

(a) grasping the cap by a peripheral edge at one end of the cap;
(b) inserting an end of the mop head into the cap at the opposite end of the cap;
(c) pulling the one end of the cap toward the other end of the mop head while stretching the elastic band;
(d) lifting the peripheral edge of the cap over the attachment plate of the mop head;
(e) soaking the mop head and the cap in a liquid cleansing solution and rinsing such cleansing solution from the mop head and the cap by passing the liquid cleansing solution to and from the sponge and through the cap;
(f) mopping the floor in a customary manner with only the mopping surface engaging the surface of the floor.

7. A method of restoring an integrated mop unit in accordance with claim 6 further including the steps of:

(g) removing the cap from the mop head when the cap becomes soiled and hinders the process of cleaning;
(h) cleansing the cap by laundering;
(i) repositioning the cleansed cap on the mop head, and
(j) repeating the soaking and mopping steps.

* * * * *